United States Patent [19]

Spearow

[11] Patent Number: 4,860,643

[45] Date of Patent: Aug. 29, 1989

[54] VENTILATED CLEAN ROOM WORK STATION WITH AERODYNAMIC EXHAUST BAFFLE

[75] Inventor: Ralph G. Spearow, Kuna, Id.

[73] Assignee: Santa Clara Plastics, Boise, Id.

[21] Appl. No.: 222,526

[22] Filed: Jul. 21, 1988

[51] Int. Cl.[4] ..... B08B 15/02

[52] U.S. Cl. ..... 98/115.3; 126/299 R

[58] Field of Search ..... 98/33.1, 115.1, 115.3, 98/36; 126/299 R, 299 D, 299 C

[56] References Cited

U.S. PATENT DOCUMENTS 3,041,957 7/1962 Liptay ..... 98/115.3
3,356,006 12/1967 Scott ..... 98/115.3 X
3,358,579 12/1967 Hauville ..... 98/115.3
3,728,866 4/1973 Layton ..... 98/115.3 X
4,676,144 1/1987 Smith, III ..... 98/115.3 X

*Primary Examiner*—Harold Joyce
*Attorney, Agent, or Firm*—Limbach, Limbach & Sutton

[57] ABSTRACT

A ventilated work station for wet processing in laminar flow clean rooms is provided in which an aerodynamically shaped baffle comprises four continuous, curved surfaces which direct laminar air flow across the work station without creating hazardous conditions due to loss of fume containment. The laminar flow is further maintained without the creation of undesirable particle concentrating vortices at, or near, the work station surface. The aerodynamic exhaust baffle has two vertical surfaces joined by the two curved surfaces. Exhaust ducts are positioned along the first curved surfaces to thereby enhance the laminar flow contours.

5 Claims, 2 Drawing Sheets

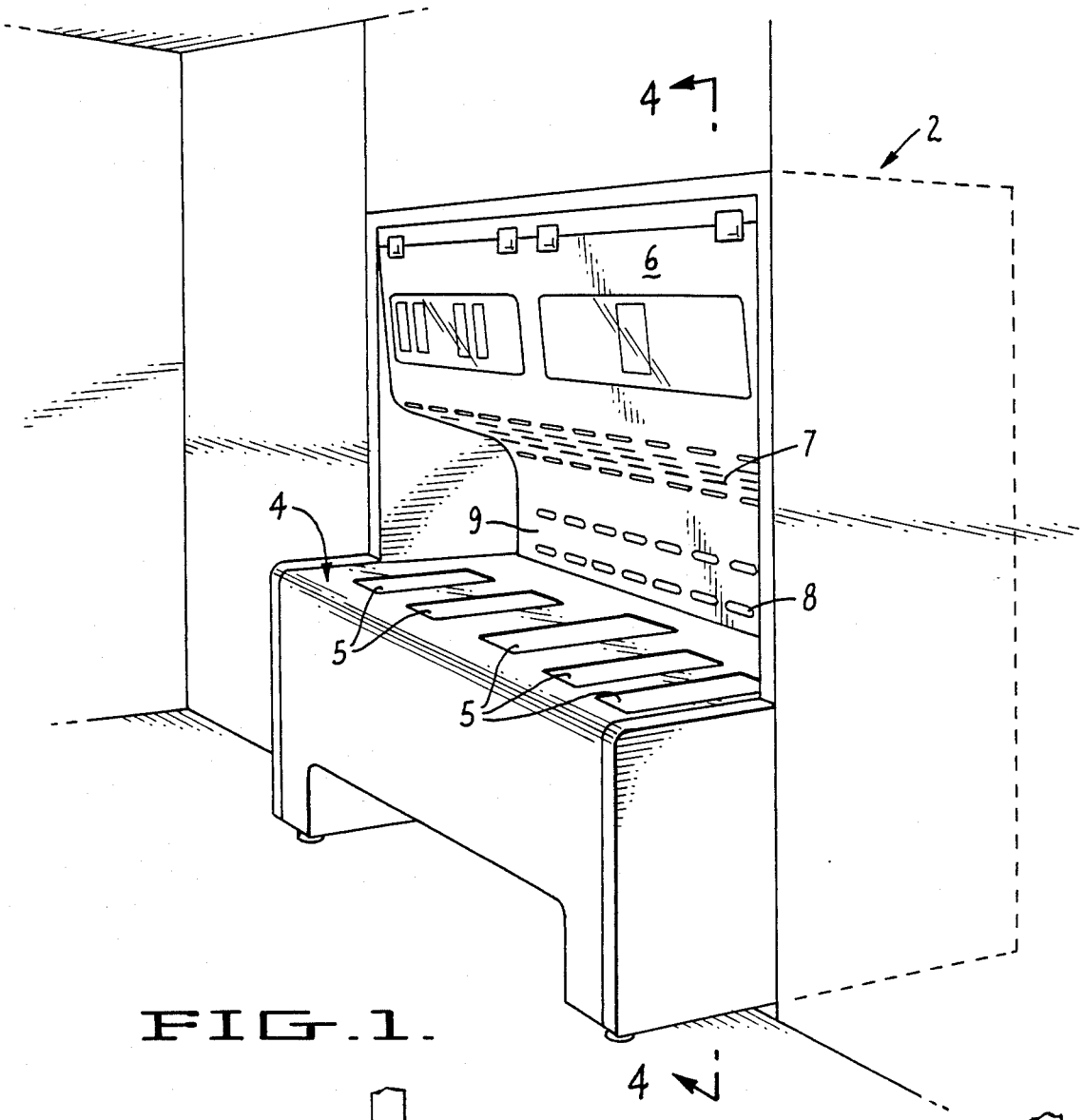
FIG. 1.
(PRIOR ART)
FIG. 2.
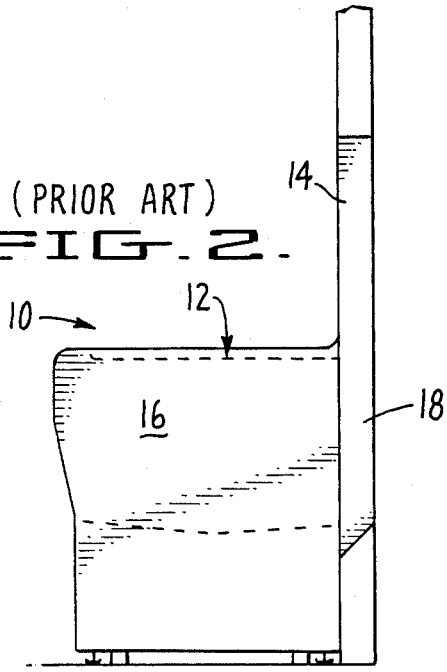
(PRIOR ART)
FIG. 3.
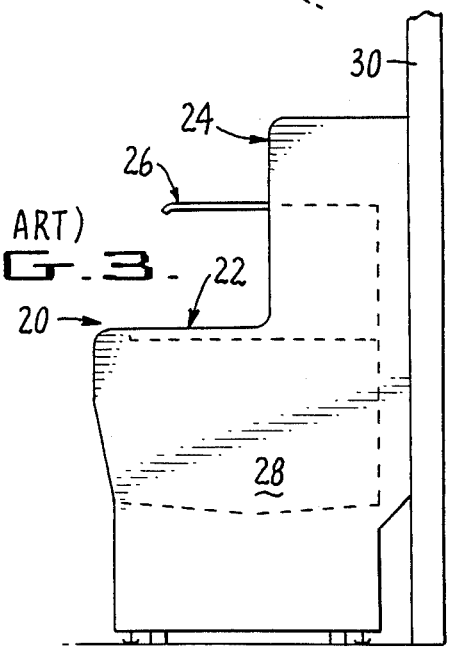

VENTILATED CLEAN ROOM WORK STATION WITH AERODYNAMIC EXHAUST BAFFLE

TECHNICAL FIELD

This invention relates generally to ventilated work stations for use in laminar flow clean rooms. More specifically, this invention relates to an aerodynamic exhaust baffle which is positioned above the work surface. This exhaust baffle directs the laminar flow across the work surface without generating undesirable disturbances and turbulence in the laminar flow. In a preferred embodiment, this ventilated work station is used for wet processing in the manufacture of integrated circuits in clean rooms.

BACKGROUND OF THE INVENTION

In the fabrication of semiconductor integrated circuits, most of the manufacturing steps take place in laminar air flow clean rooms which are designed to reduce the number of particles in the production environment. Maintaining this clean room free of particulate matter is critical to the semiconductor integrated circuit fabrication process since the largest single cause of reduced yield is particulate matter.

Wet processing is one of the many steps in semiconductor integrated circuit fabrication. In wet processing, the wafer/substrate is exposed to a variety of liquids, such as acids, bases and solvents, by immersion of the wafer in a tank containing the desired process liquid. Typically, a wet process work station area in a clean room provides a plenum area in which these process liquid tanks and their support plumbing are mounted. It is also desirable to mount the process control electronics immediately adjacent the liquid tanks. In this type of configuration, the wet process work station provides a shell in which to physically mount all of these components. The wet processing work station should additionally provide a controlled environment for processing by containing the liquids and their vapors, as well as controlling and cooperating with the clean room-wide laminar flow past the processing area.

The clean room air flow management in and around a wet processing work station must address the overall laminar flow in the clean room, as well as the localized fume conditions resulting from evaporation of process fluids or workpiece immersion in a particular process fluid. Thus, fume management and air flow control are critical due to the following reasons: safety—proper fume capture prevents exposing the operators to potentially hazardous conditions; process—fume capture prevents any cross-contamination between different chemicals or accidental exposure of the product to unwanted chemical fumes and keeps clean laminar air flowing past the process work area to aid in reducing product defects caused by airborne particulates; environment-/facilities—prevention of fumes escaping from within the system reduces potential environmental problems; minimizing the exhaust flow rate required which, in turn, minimizes the makeup air required to replace it, thereby reducing the energy needed and, therefore, the clean room facility operating cost.

There are currently two basic work station designs utilized in the semiconductor industry. The first work station design 10, as shown in FIG. 2 labeled prior art, employs a work surface 12 and flat back 14. In this design, the station 10 must exhaust all of the laminar air flow hitting the deck surface plus an additional small percentage increase to allow for small fluctuations in air velocity while maintaining a positive flow. In the example described with reference to FIG. 2, if the work surface is 30.00 inches wide, then it is estimated that the exhaust rate required per foot of work station length would be 275 to 300 cubic feet per minute (CFM) if the work station were placed in a 100 foot per minute (FPM) laminar area. This exhaust would be directed through the work station area 16 and then through ducts in the wall 18. With some adjustment in exhaust flow rate to balance the system for a specific configuration, this type of station could contain the fumes generated at the work station, and provide a clean laminar air working environment. However, this prior art design requires very high exhaust flow rates resulting in higher clean room operating costs.

The second commonly used work station design 20 for clean room ventilation is shown in FIG. 3, also labeled PRIOR ART. In this apparatus, the horizontal work surface 22 is partially covered by a headcasing 24 and by a shield 26 which extend partially across the width of the horizontal work surface. Like the flat back design described with respect to FIG. 2, the area 28, below the horizontal work surface 22, is hollow and is ducted to exhaust the fumes/vapors through the wall 30. This configuration prevents the laminar flow of air from directly hitting the horizontal work surface. As a result, this flow of air does not have to be exhausted through the work station ducts, and instead is exhausted through the clean room exhaust ducts, placed either in the floor or in the wall baseboards. For purposes of fume control and cleanliness, the important operating principle of this prior art design is to maintain enough air flow through the space between the horizontal work surface 22 and the shield 26 to prevent the escape of fumes from the wet processing work station. The exhaust capacity required to maintain such a positive flow through this front opening can be as low as 100 to 125 CFM per foot of station length, as contrasted with the 275 to 300 CFM per foot required in the flat back design.

Even though this second prior art design permits reduced exhaust air flow rates while maintaining fume containment, it does not adequately maintain a clean working environment because the air flow under head casing 24 and shield 26 is turbulent. There will be one or more air vortices generated under the shield 26 whose axes are parallel to the length of the horizontal work surface. These air flow vortices under shield 26 allow fumes and airborne particles to collect and travel the length of the horizontal work surface 22, which thereby disrupts the clean working environment necessary for semiconductor manufacture.

The present invention provides a ventilated work station design which operates at reduced exhaust flow rates while maintaining laminar flow in the region adjacent the horizontal work surface. This desirable combination of characteristics provides an efficient and simple unit whose operating costs are minimized.

Therefore, it is an object of the present invention to provide a simple ventilated work station design to maintain a laminar flow clean room wet processing work station substantially free of particulate matter.

It is a further object of this invention to provide a ventilated work station in a laminar flow clean room which is safe and which minimizes the risk of operator exposure to potentially hazardous fumes emanating from the ventilated work station wells.

It is a still further object of this invention to provide a ventilated work station for use in laminar flow clean rooms which does not require large (and expensive) exhaust flow capacities through the work station ventilation/exhaust ducts to achieve both fume control and work station cleanliness.

It is another object of the instant invention to provide a ventilated work station, free of turbulent flow regions in the processing area to minimize any potential cross-contamination of substrates due to the uncontrolled migration of fumes from one wet processing well to the next.

These and further objects of the present invention will become readily apparent to those of ordinary skill in the art from the detailed description of the invention and the figures which follow.

SUMMARY OF THE INVENTION

The present invention provides a ventilated work station for material processing in a laminar air flow clean room. The apparatus has an elongate rectangular work surface, lying in a horizontal plane, having front and rear edges. There is at least one liquid well disposed within the rectangular work surface for receiving workpieces to be processed in process liquids and/or solvents. There is further provided, above the rectangular work surface, an aerodynamic exhaust baffle which has two substantially vertical surfaces joined by two continuous curved surfaces. The first vertical surface of the aerodynamic exhaust baffle is located above, and nearly perpendicular to, the middle of the rectangular work surface, extending across substantially one-half (at least forty percent) of the rectangular work station width. The first curved surface of the baffle begins at the bottom of the first vertical surface, and then curves back towards the rear edge of the rectangular work surface. The second vertical surface of the baffle extends vertically from the rear edge of the rectangular work surface. The second curved surface, beginning at the top of the second vertical surface, connects to the first curved surface, thereby providing a continuous surface from the top of the first vertical surface to the rear edge of the rectangular work surface. Lip exhaust means for exhausting fumes generated at the rectangular work surface, and for exhausting flowing air, are disposed in the annular spaces between said at least one well in the rectangular work surface and the edges of said rectangular work surface. Primary exhaust means are provided for exhausting a large volume of air at said rectangular work surface, and are disposed along the second vertical surface, above the rectangular work surface. Curved surface exhaust means are also provided in the baffle first curved surface to improve laminar air flow along the aerodynamic exhaust baffle surfaces.

BRIEF DESCRIPTION OF THE FIGURES

FIG. 1 is a perspective view of the ventilated work station according to the present invention.

FIG. 2 is an end view of a prior art device known as a flat back bench.

FIG. 3 is an end view of a second prior art device having a shield above the work station deck.

DETAILED DESCRIPTION OF THE INVENTION

Figure 6:
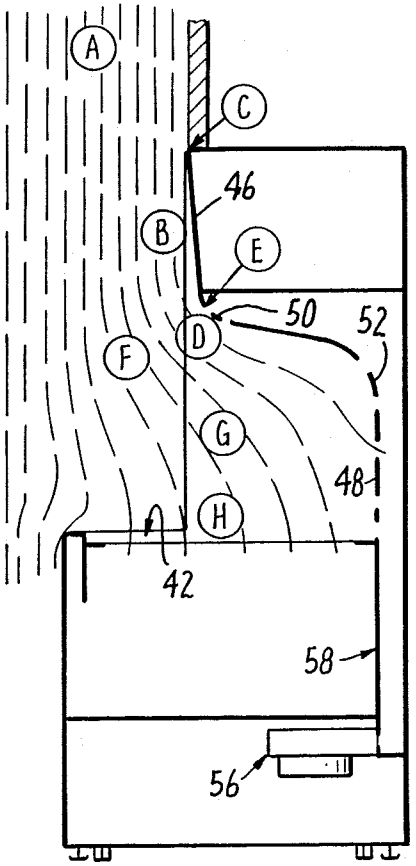
FIG. 6 is the end view of the apparatus shown in FIG. 4, including air flow streamlines.

The main cause of semiconductor integrated circuit failure, as mentioned above, is particulate contamination in the fabrication process. The semiconductor device typically becomes contaminated during one of its processing stages, where the substrate or deposited elements are directly exposed to the environment. Therefore, optimal semiconductor production yield is directly related to the cleanliness of the production environment, or clean room.

Clean rooms are classified by Federal Standards according to the number of particles per cubic foot; for example, a clean room designated as Class 100 would have a limit of 100 particles (0.5 micron, or larger, in size) per cubic foot.

To maintain these extremely low levels of particulate concentration, two clean room designs, based on the manner in which air is circulated in the room, are typically utilized. Non-laminar air flow clean rooms control particle concentration by introducing clean filtered air through ducts near the ceiling and exhausting stale air through return ducts near the floor around the periphery of the room. This design, although simple and efficient, is inadequate for those critical operations which require extremely low levels of particulate concentration.

A more suitable design utilizes room-wide laminar flow. Here, "highly filtered air is brought into the room towards the work area through a filter bank comprising an entire wall or ceiling of the room, and exhausted through the entire opposite surface facing the air inlet filter bank." Fed. Std. No. 209B, p.8 (1973). In this context, laminar flow is defined as "air flowing in a single pass in a single direction through a clean zone with generally parallel streamlines." Fed-Std-209C, October 1987. Therefore, in a laminar flow clean room, particles are swept out of the room by the undisturbed current of air flowing from ceiling to floor.

Typically, air flow is directed from ceiling-to-floor for minimum particle concentration. Standard air velocity through the cross section of the room is 90 ft/min$\pm$20%. (Fed. Std. No. 209B, p. 17 (1973)).

Maintaining the laminar quality of the air flow is essential to minimizing particle contamination; any interference with the laminar streamlines can disrupt the flow, resulting in turbulence. This turbulent condition tends to trap particulate matter in the room. Thus, specific attention must be directed to the proper design of equipment and work stations which would minimize disturbances in laminar flow.

In the wet processing phase of semiconductor integrated circuit manufacture, the silicon or gallium-arsenide based wafer or substrate, which may have a number of layers of conductive, dielectric and/or photolithographic materials deposited thereon, is exposed to various liquids by immersion; depending on the stage of production, the wafer may be immersed in acids, bases or solvents. Typically, processing liquids include: deionized water, HF based materials (ambient temperature); $H_2SO_4$ (120°-140° C.); $H_3P0_4$ (170° C.); $NH_4Cl$ solutions (100° C.); solvents such as acetone, alcohols, n-methyl pyrilidine (100° C.) and proprietary solvents.

A primary objective of this invention is to provide adequate and economic fume control for these often highly toxic liquids, while minimizing disturbance of the laminar air flow in the work station area. The aerodynamic exhaust baffle and work surface of the present invention are integrated members of the clean room. The baffle and work surface are situated such that they are embedded within the wall, and do not disrupt the laminar air flow. Only a portion of the rectangular work surface protrudes from the wall; all other elements of the ventilated work station lie in the core area, behind the plane of the wall.

Figure 5:
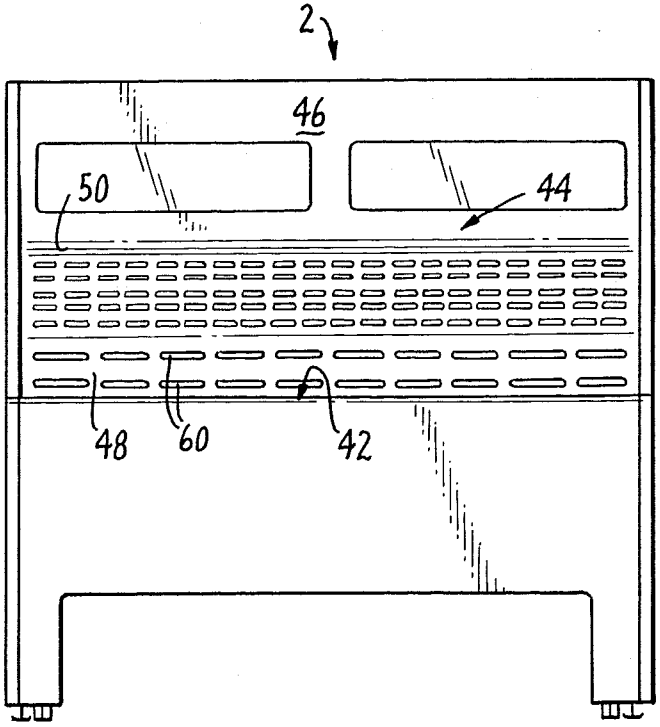
FIG. 5 is a front view of the present invention.

A particularly preferred embodiment of the invention is described with reference to FIGS. 1, 4 and 5. Air flow contours in the laminar flow clean room are illustrated in FIG. 6.

The basic components of the apparatus are shown in FIG. 1. The ventilated work station 2 is embedded into the wall of the clean room, as indicated by the broken lines in FIG. 1. A horizontal, rectangular work surface 4 has workpiece—receiving wells 5 formed in it for receiving liquid tanks and trays, as well as for accommodating process control instrumentation which is required to perform material movement and/or adjust processing conditions. A first vertical surface 6 is substantially, but not entirely, vertical being slightly inclined from the rear to front edges of the rectangular work surface 4. Curved surface exhaust vents 7 are provided to aid laminar flow across the work station from top to bottom of the aerodynamic exhaust baffle. Primary exhaust vents 8 are formed in the plastic or metal sheets used to create the baffle surface, and remove a larger volume of the laminar flow impacting upon the rectangular work surface 4.

Positioned above the work surface 42, is the aerodynamic exhaust baffle 44. The aerodynamic exhaust baffle 44 has two substantially vertical surfaces 46, 48, which are joined by two continuous curved surfaces 50, 52, respectively. The first substantially vertical surface 46 which is slightly inclined from the perpendicular, begins flush to the clean room wall. It is nearly perpendicular to, and positioned above, the work surface 42 approximately midway between the front and rear edges of the work surface 42. The first substantially vertical surface 46 slants inward, toward the rear edge of the work station surface 42. The first curved surface 50 begins at the bottom of the first substantially vertical surface 46, and curves further inward, towards the rear edge of the work surface 42, where it becomes essentially horizontal. The radius of curvature r for the first curved surface 50 is preferably between 3 inches and 5 inches, and in the preferred embodiment, r is $4\frac{3}{8}$ inches.

A second vertical surface 48 extends vertically from the work surface 42 rear edge. A second curved surface 52 extends continuously from the top of the second vertical surface 48, and bends horizontally outward, towards the front edge of the work surface 42, where it intersects with the first curved surface 50. The radius of curvature R of the second curved surface 52 is preferably between 6 inches and 12 inches and in the preferred embodiment, R is 8 inches. The four individual sections of the aerodynamic baffle (two substantially vertical surfaces 46, 48 and two curved surfaces 50, 52) are arranged to form one continuous smooth surface, which causes the baffle to project substantially over one half the width of the work surface 42, and along its entire length.

At least one well 54 is installed within the work station 2 to contain liquids for wet processing. The mouth of the well(s) 54 opens through the work surface 42, thus enabling operators to immerse workpieces into the liquid. An exhaust pump 56 is positioned below the work surface and is ducted to create a flow into the exhaust vents throughout the work station. To remove the fumes generated at the work surface 42, as well as to remove a portion of the circulating laminar flow air, lip exhaust means 58 are positioned in the annular spaces between the wells 54 in the work surface 42 and the perimeter of the work surface 42. Primary exhaust means 60 remove large volumes of air flowing into the work station area, and these exhaust vents are disposed on the second vertical surface 48, above the work surface 42. Curved surface exhaust means 62 constitute vents which are disposed along the length of both curved surfaces 50 and 52, respectively to maintain laminar flow over the contours of the aerodynamic exhaust baffle 44. In FIG. 1, these curved surface exhaust means vents 62 are visible along the two curved surfaces 50 and 52. The air flow rate around this vicinity is effectively controlled by selecting the appropriate curved surface exhaust duct size. Optimally, the duct size should range from $\frac{1}{2}''$ to $1''$.

Figure 4:
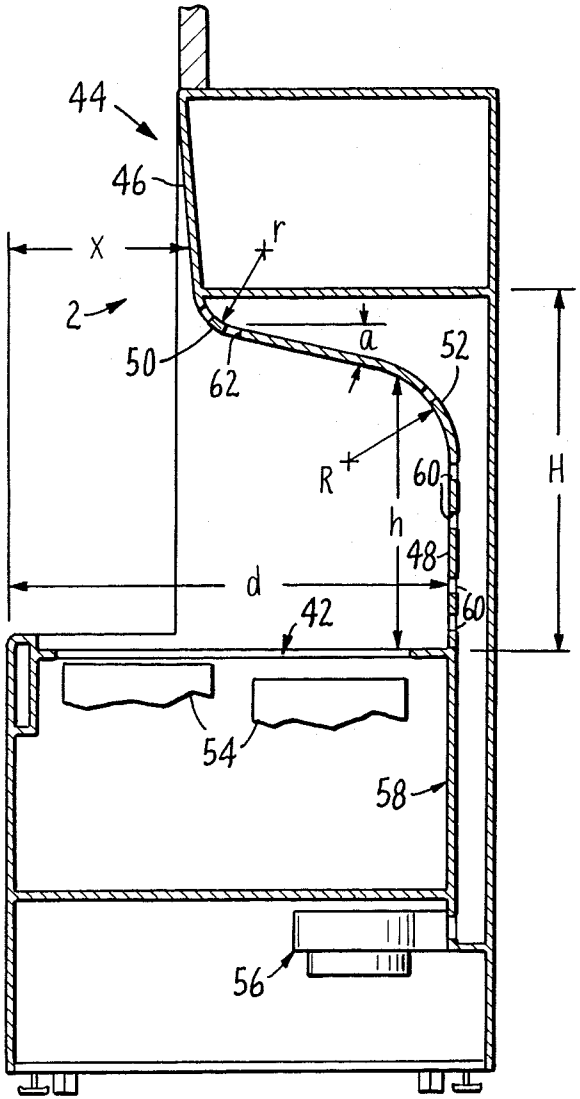
FIG. 4 is an end view of the present invention.

Regarding the relative physical dimensions of the ventilated work station, as shown in FIG. 4, the height, h, between the work surface 42 and the lowest point of the first curved surface 50 ranges between 15 inches and 20 inches, preferably 18 inches. The angle, a, measured from the horizontal to the lowest point of the first curved surface 50 is between 10° and 15°. The distance, H, between the bottom of the first substantially vertical surface 46 and work station deck 42 is between 22 inches and 27 inches given the dimensions for h, r and a. The width, d, of the work surface 42 ranges from 32 inches to 35 inches. The headcasing set back x dictates the amount of air entering the work station area. x is measured horizontally from the front edge of the work surface 42 to the vertical plane of the wall above the aerodynamic exhaust baffle 44, and depends on the width d of the work surface 42. For optimal results, the ratio x/d is between 0.4 and 0.5; therefore x is between 15 inches and 16 inches given the above work surface width d.

For wet processing applications involving acids and bases, the aerodynamic exhaust baffle is preferably made from polypropylene, fire retardant polypropylene or polyvinyl chloride. Readily available $4' \times 8'$ sheets of plastic are shaped and then welded together using hot air and melting rods to form the joints between the curved surfaces. For less corrosive applications, such as organic solvents, the baffle can be fabricated from stainless steel.

The air flow contours over the aerodynamic exhaust baffle within a ceiling-to-floor laminar flow environment are shown in detail in FIG. 6. Where the laminar air flow past the front of the ventilated work station (Area "B"), and the point at which it interfaces with the wall (Point "C"), the surfaces must be smooth. The momentum of the air is low because of low velocity and mass and, therefore, the air will maintain laminar flow through this area only if there are no sharp projections or disruptions in the flow stream. If there are disruptions in the flow streams here, or upstream from here, the formation of a standing vortex or the separation of the flow stream from the surface will occur. If this occurs, the air flow disruption will carry downstream and defeat the intent of the present invention.

The laminar air flows past Area "B" into the first curved areas (Area "D"). Because of the small radius of curvature and the slight momentum of the air, the natural tendency of the laminar flow stream is to separate from the surface at Point "E". This is avoided by two half-inch wide exhaust slots. The slots draw air from the laminar flow straight into the negatively pressurized exhaust baffle. By removing air at these two points, a negative potential region is formed. This overcomes the momentum of the laminar flow stream and causes it to follow the curved surfaces. This change in the direction of the laminar flow stream is carried out into Area "F".

As the laminar air flows into Area "G", the cross sectional area across which the air flows increases. As this area increases, the velocity at which the air flows decreases. Typically, the velocities in this area decrease to 60 FPM.

The laminar air continues at this reduced velocity toward the exhaust baffle and rectangular work surface 42. The air moving toward the exhaust baffle is withdrawn through four exhaust slots. The air moving toward the rectangular work surface is withdrawn through the lip exhaust slots around the chemical processing tanks. As the air moves through these exhaust slots, the velocity increases to approximately 400 FPM at the tank lip. This high velocity coupled with the laminar air flow moving down will capture any chemical fumes generated by the chemical processing tanks.

In summary, this design provides clean laminar air in the ventilated work area (Area "H") while maintaining a relatively low volume flow rate of air exhausted, approximately 160 CFM per linear foot of station.

I claim:

1. A ventilated work station for workpiece processing in a laminar flow clean room which comprises:

(a) an elongate rectangular work surface, lying in a horizontal plane, having front and rear edges parallel to said work surface longitudinal axis;

(b) at least one well within said work surface for receiving workpieces to be processed;

(c) an aerodynamic exhaust baffle having two substantially vertical surfaces joined by two continuous curved surfaces, said baffle positioned above said rectangular work surface, said first substantially vertical surface and a first curved surface extending substantially across one half the width of said elongate, rectangular work surface and extending along the entire length of said elongate, rectangular work surface, and said second substantially vertical surface and second curved surface extending vertically from the rear edge of said work surface and extending along the entire length of said elongate, rectangular work surface;

(d) primary exhaust means for exhausting a large volume of air, falling upon said rectangular work surface, said primary exhaust means disposed on said second vertical surface; and, (e) curved surface exhaust means for improving laminar flow along said aerodynamic exhaust baffle surfaces, disposed on said first curved surface.

2. The apparatus of claim 1 further comprising:

(a) lip exhaust means for exhausting fumes generated at said work surface and for exhausting air flowing upon said rectangular work surface, said lip exhaust means disposed in annular spaces between said at least one well in said horizontal work surface and the perimeter of said rectangular work surface.

3. The apparatus of claim 1 wherein the radius of curvature of said first curved surface is between 3 inches and 5 inches.

4. The apparatus of claim 1 wherein the distance between said first curved surface and the rectangular work surface is between 15 inches and 20 inches, as measured from said work surface horizontal plane to the lowest point of the first curved surface.

5. The apparatus of claim 1 wherein the radius of curvature of said second curved surface is between 6 inches and 12 inches.

* * * * *

UNITED STATES PATENT AND TRADEMARK OFFICE

CERTIFICATE OF CORRECTION

PATENT NO. : 4,860,643

DATED : August 29, 1989

INVENTOR(S) : Ralph G. Spearow

It is certified that error appears in the above - identified patent and that said Letters Patent is hereby corrected as shown below:

In Col. 1/line 35 - add the word "to" after "adjacent."

In Col. 3/line 23 - change "elongate" to "elongated."

In Col. 6/line 53 - change "flow" to "flows."

Signed and Sealed this

Twenty-fifth Day of December, 1990

*Attest:*

HARRY F. MANBECK, JR.

*Attesting Officer*

*Commissioner of Patents and Trademarks*